US005334094A

United States Patent [19]

Armbruster et al.

[11] Patent Number: 5,334,094

[45] Date of Patent: Aug. 2, 1994

[54] CARBONLESS PAD ASSEMBLY

[75] Inventors: June M. Armbruster, River Falls, Wis.; Louis M. Leichter, Mendota Heights, Minn.

[73] Assignee: Minnesota Mining and Manufacturing Company, Saint Paul, Minn.

[21] Appl. No.: 948,164

[22] Filed: Sep. 21, 1992

[51] Int. Cl.[5] ..... B41L 1/24

[52] U.S. Cl. ..... 462/17; 281/42; 462/18; 462/55; 462/56

[58] Field of Search ..... 281/42; 462/17, 18, 462/19, 20, 55, 56

[56] References Cited

U.S. PATENT DOCUMENTS

| | | | |
|---|---|---|---|
| 2,532,011 | 11/1950 | Dahlquist et al. | 154/53.5 |
| 2,800,427 | 7/1957 | Junk, Jr. et al. | 196/14.11 |
| 2,800,458 | 7/1957 | Green | 252/316 |
| 3,416,441 | 12/1968 | Maul et al. | 101/56 |
| 3,429,827 | 2/1969 | Ruus | 252/316 |
| 3,516,846 | 6/1970 | Matson | 117/36.2 |
| 3,691,140 | 9/1972 | Silver | 260/78.5 |
| 4,087,376 | 5/1978 | Foris et al. | 252/316 |
| 4,100,103 | 7/1978 | Foris et al. | 252/316 |
| 4,201,404 | 5/1980 | Charbonneau et al. . | |
| 4,334,015 | 6/1982 | Yarian | 435/1 |
| 4,798,401 | 1/1989 | Greig | 281/42 |
| 4,906,605 | 3/1990 | Kraft | 503/215 |
| 4,909,605 | 3/1990 | Asano et al. | 350/346 |
| 4,934,740 | 6/1990 | Drake | 462/17 |
| 5,045,569 | 9/1991 | Delgado | 522/69 |
| 5,153,041 | 10/1992 | Clements et al. | 462/55 X |
| 5,199,923 | 4/1993 | Muller | 462/20 X |

FOREIGN PATENT DOCUMENTS

| | | |
|---|---|---|
| 950443 | 5/1960 | United Kingdom . |
| 1046409 | 6/1970 | United Kingdom . |

*Primary Examiner*—Paul A. Bell

*Attorney, Agent, or Firm*—Gary L. Griswold; Walter N. Kirn; Thomas C. Lagaly

[57] ABSTRACT

The present invention comprises a pad assembly for carbonless sheets. The assembly comprises a plurality of carbonless sheets wherein each sheet is disposed in a stack and wherein each carbonless sheet has a band of repositionable pressure sensitive adhesive coated on a rear surface of the pad.

17 Claims, 2 Drawing Sheets

CARBONLESS PAD ASSEMBLY

TECHNICAL FIELD

The present invention relates to pad assemblies of the type including a multiplicity of aligned flexible carbonless sheets in a stack which are attached together along or adjacent aligned edges of the sheets so that any of several uppermost individual sheets in the stack can either (1) be bent or pivoted away from an adjacent underlying sheet so that the underlying sheet can be written on, or (2) be separated from the stack so that the separated carbonless sheets can be used elsewhere or disposed of; and in one important aspect, to such pad assemblies useful for message and note taking where copies wish to be made or kept for future reference; and in another aspect, to such pad assemblies that are large in size, and in which the stack is mounted on a stiff back card so that the pad assembly can be supported in a vertical position at the front of a room during a meeting and used to record lists of items or ideas generated during the meeting.

BACKGROUND OF THE INVENTION

Many pad assemblies include a multiplicity of aligned flexible sheets (i.e., typically paper sheets) in a stack which are attached together along or adjacent aligned edges of the sheets. Some such pad assemblies are large in size and include a stiff back card on which the stack is mounted so that the pad assembly can be supported at the front of a room on a support such as an easel during a meeting and used to record lists of items or ideas generated during the meeting. During such use, typically one or more of the uppermost sheets on the pad, after being written on, are either (1) bent or pivoted away from an underlying sheet so that they project over and are supported on an upper support edge of the back card and the underlying sheet can be written on, or (2) are separated from the stack so that the separated sheet or sheets can be positioned elsewhere, typically on the walls of the room to which they are attached by means such as a clip, pin or a length of adhesive coated tape so that information on the separated sheets can easily be viewed by the participants of the meeting. In some such pad assemblies, the sheets are attached together by a layer of padding compound along the one edge portion which allows the individual sheets to be separated from the padding compound or pivoted away from underlying sheets by bending the layer of padding compound. In the most common type of such pad assemblies, the sheets are attached together by staples through portions of the sheets adjacent the aligned edges of the sheets. Such staples more firmly hold the sheets together, but require portions of the sheets around the staples to be bent when the sheets are supported on the support edge and to be torn away when the sheets are removed from the pad; whereas in yet other type of such pad assemblies, the sheets are attached together by staples through portions of the sheets adjacent the aligned edges of the sheets and are transversely perforated just below the staples so that the sheets can be torn off along their lines of perforation, or folded along the lines of perforations when the sheets are supported on the support edge.

A pad assembly commercially designated "Clingers" and available from the Ampad Corporation, Holyoke, Md., comprises a multiplicity of flexible sheets disposed in a stack with the corresponding edges of the sheets aligned and with each sheet having a band of repositionable pressure sensitive adhesive coated on its rear surface along aligned first edges of the sheets, and the band of repositionable pressure sensitive adhesive on each sheet adhering it to the front surface of the adjacent sheet in the stack. Sheets removed from the "Clingers" pad assembly can be releasably adhered to a support surface by the bands of repositionable pressure sensitive adhesive on the sheets. Only the top sheet from such a pad assembly can be easily removed, however, which is a significant disadvantage of such a pad assembly compared to the pad assemblies described above from which underlying sheets in the pad can be easily removed prior to removal of the uppermost sheet in the pad. Also, the pressure sensitive adhesive on the sheets from the "Clingers" pad assembly will not very stick long to anything but the smoothest of wall surfaces, such as painted sheet rock and metal surfaces, glass, or the like.

In distinction to the above-described pad assemblies, U.S. Pat. No. 4,798,401 (Grieg) discloses a pad assembly utilizing carbonless sheets. The Grieg pad assembly comprises a multiplicity of flexible carbonless sheets disposed in a stack with the corresponding edges of the carbonless sheets aligned and with each carbonless sheet having a band of repositionable pressure sensitive adhesive coated on its rear surface along aligned first edges of the carbonless sheets, and the band of repositionable pressure sensitive adhesive on each carbonless sheet adhering it to the front surface of the adjacent sheet in the stack.

Carbonless copy papers are those which are capable of producing an image upon application of pressure. Products employing this chemistry generally contain at least two substrates (for example, two sheets of paper) and involve coating one reactant, known as a color-former, on one substrate, and the other reactant, known as a developer, on another "mating" substrate. One surface, or side, of each substrate is coated with one of the two primary reactants. The two substrates are often referred to as a donor sheet and a receptor sheet. Means for preventing the reacting of the two until intended (i.e., until activating pressure is applied) are also provided. This is typically accomplished by encapsulation of one of the reactants.

In one type of construction an encapsulated fill solution of a color-former, dissolved in appropriate hydrophobic solvent(s), is coated with a suitable binder onto a back side a sheet of paper to form the donor sheet. This donor sheet is sometimes referred to as a "coated back" (CB) sheet. Each CB coating contains rupturable capsules which, when ruptured, release reagents to produce a color-changing reaction at the adjacent CF coating. The microcapsules serve the purpose of isolating the reactants from one another and preventing reaction. A developer, also optionally in a suitable binder such as a starch or latex, is coated onto the front side of a second sheet of paper to form the receptor sheet. This receptor sheet is sometimes referred to as a "coated front" (CF) sheet. The term "suitable binder" refers to a material, such as starch or latex, that allows for dispersion of the reactants in a coating on a substrate.

Substrates, with one surface on which is coated the encapsulated color-former, and a second, opposite, surface on which is coated a developer can be placed between the CF and CB sheets, in a construction involving a plurality of substrates. Such sheets are generally referred to herein as "CFB" sheets (i.e., coated front and back sheets). Of course, each side including color-former thereon should be placed in juxtaposition with a sheet having developer thereon.

While it is customary to coat the capsules on the back surface and coat the developer on the front surface, this procedure can be reversed if desired.

In imaging, the two sheets are positioned such that the back side of the donor sheet faces the developer coating on the front side of the receptor sheet. Once activating pressure is applied to the uncoated surface of the donor sheet, such as from a stylus or business-machine key, the two substrates come into contact under sufficient pressure so that the capsules rupture (i.e., those capsules corresponding to the pattern of applied pressure) and the solution of encapsulated color-former is released and transferred from the donor sheet to the receptor sheet. On the receptor sheet, a reaction between the previously separated reactants occurs. Since the color-former and the developer form a deeply colored image when reacted, an image forms on the receptor sheet. In general, the resulting reaction will, of course, form a colored image corresponding to the path traveled by the stylus, or the pattern of pressure provided by the stylus or key and the image appearing on the receptor (CF) sheet is therefore a copy of the image applied to the top sheet. In many applications the uncoated surface of the donor (CB) sheet contains a form of some type and the activating pressure is generated by means of a pen or other writing instrument used in filling out the form. The term "activating pressure" includes, but is not limited to, pressure applied by hand with a stylus or pressure applied by a business machine key, for example, a typewriter key; and the term "encapsulation" and "encapsulated compounds" refer to microcapsules enclosing a fill material. Papers prepared in this manner and incorporating CB, CFB, and CF sheets have bee sold by 3M Company (St. Paul, Minn.) under the names of "Action 200" Carbonless Paper, and "Scotchmark" Carbonless Paper.

Another type of carbonless paper is referred to as a self-contained (SC) or autogenous carbonless paper. In self-contained carbonless papers, both the color-former, generally in encapsulated form, and developer are applied to the same side of the sheet. The color-former may be encapsulated and incorporated into the fiber lattice of the paper sheet during the manufacture of the paper. The developer, optionally in a binder, can then be coated onto the surface of the paper. Papers prepared in this manner have been sold by the 3M Company under the name of "Action 100" Carbonless Paper. Alternatively, the color-former may be encapsulated and coated with the developer, and an optional binder, onto the paper. Papers prepared in this manner have been sold by the 3M Company under the name of "Action 300" Carbonless Paper. The SC sheet is positioned below a plain-paper top sheet. In either system, when pressure is applied, again as by a typewriter or other writing instrument, the color-former capsule is ruptured and reacts with the surrounding developer to form a mark. Capsule rupture typically takes place under hand-held stylus pressure, or typical business machine key pressure.

The preparation of carbonless paper constructions employing CB, CF, and CFB sheets as well as carbonless paper constructions employing SC sheets constructions is disclosed in U.S. Pat. Nos. 3,516,846 and 3,516,941 incorporated herein by reference.

Constructions containing a first substrate surface, on which is coated the encapsulated color-former and a second substrate surface on which is coated a developer are often prepared. The coated first substrate surface is positioned within the construction in contact with the coated second substrate surface. Such a construction is known as a "set" or a "form-set" construction. Sets of 3 or more sheets can be prepared by incorporating CFB sheets between the CB and CF sheet. Thus, the sheets in the set are sequenced in the order (from top to bottom) CB, CFB(s), and CF. This insures that in each set a color former and a color developer will be brought into contact when the microcapsules containing the color-forming material are ruptured by pressure. Sets of 3 or more sheets can also be prepared by adding additional SC sheets to the construction. Carbonless paper is often used in the form of pre-printed sets, often called form-sets for preparing multiple copies of receipts, bills, and other business forms and form-sets are prepared by collating from 2 to 8 sheets.

Another carbonless paper pad assembly commercially designated "eSeetac" and available from the Barton Nelson Company of Kansas City, Mo., comprises a multiplicity of aligned flexible carbonless paper sheets. Each carbonless paper sheet is separated from the adjacent carbonless paper sheet by a divider. The carbonless paper sheets and dividers are attached along one edge portion to form a stack from which any of several uppermost individual carbonless paper sheets or dividers be pivoted away from an adjacent divider. In addition, the carbonless paper sheets can be separated from the stack and releasably adhered to a support surface by repositionable pressure sensitive on the carbonless sheet.

SUMMARY OF THE INVENTION

The present invention provides a pad assembly of the type including a multiplicity of aligned flexible carbonless sheets attached together along one edge portion to form a stack from which any of several uppermost individual carbonless sheets can either be pivoted away from an adjacent carbonless sheet, or can be separated from the stack and releasably adhered to a support surface by a repositionable pressure sensitive adhesive on the carbonless sheet that can adhere well to many rough surfaces. Such pad assemblies are particularly useful for message and note taking where copies wish to be made for future reference. Such pad assemblies are also useful when made large in size and to include a stiff back card whereby they can be supported at the front of a room during a meeting in a generally vertical position and used to record lists of items or ideas generated during the meeting.

According to the present invention there is provided a pad assembly comprising a multiplicity of carbonless sets, each set comprising multiplicity of flexible carbonless sheets, each sheet having a band of repositionable pressure sensitive adhesive coated on its back surface adjacent to and spaced by a small predetermined spacing from a first edge and spaced by a large predetermined spacing from a second opposite edge. The carbonless sheets are disposed in a stack with the corresponding edges of the carbonless sheets aligned, the front and rear surfaces of adjacent carbonless sheets facing each other, and the band of repositionable pressure sensitive adhesive on each carbonless sheet adhering it to the adjacent carbonless sheet in the stack. A layer of padding compound is disposed over and adhered to the aligned first edges of the carbonless sheets in the stack. The padding compound is sufficiently flexible to allow, after the band of repositionable pressure sensitive adhesive on the rear surface of one of the carbonless sheets in the stack is separated from the front surface of the adjacent carbonless sheet in the stack, that one carbonless sheet (and any carbonless sheets above it) to be pivoted away from that adjacent carbonless sheet by hinge-like flexing of the padding compound between the carbonless sheets. The padding compound will remain adhered to the adjacent carbonless sheets during such flexing while affording manual peeling of that one carbonless sheet from the padding compound to separate that one carbonless sheet from the stack. The small predetermined spacing between the band of repositionable pressure sensitive adhesive and the first edge of each carbonless sheet provides a tactile feel when the band of repositionable pressure sensitive adhesive on the rear surface of one of the carbonless sheets in the stack has been separated from the front surface of the adjacent carbonless sheet in the stack by manual peeling apart of the sheets, which tactile feel allows the user to reduce the peeling force being manually applied to the carbonless sheet and thereby restricts inadvertent separation of that carbonless sheet from the padding compound; and after that carbonless sheet is intentionally separated from the padding compound, the band of repositionable pressure sensitive adhesive on the carbonless sheet allows the user to removably adhere that carbonless sheet to a vertical support surface without the need to use tape, pins, or other separate attachment means.

The tactile feel that restricts inadvertent separation of that carbonless sheet from the padding compound is produced when that spacing is as little as 0.6 centimeter (0.25 inch) in a direction normal to the first edge of the carbonless sheet, and is well pronounced when that spacing is at least 1.2 centimeters (0.5 inch) or more. That spacing, however, preferably should not be greater than about 4 centimeters (1.5 inches) so that the portion of the carbonless sheet adjacent its first or top edge will be supported in a vertical position when a carbonless sheet is separated from the stack and adhered to a vertical surface by the band of repositionable pressure sensitive adhesive.

When used as a flip chart, the pad assembly further includes a stiff back card to which the bottom most sheet in the stack is attached, which back card is at least coextensive with the carbonless sheets in the stack. That back card can have a top edge aligned with the first edges of the carbonless sheets, or, as illustrated herein, can have a top portion projecting past the aligned first edges of the carbonless sheets, which top portion has a peripheral support edge generally parallel to the first edges of the carbonless sheets over which support surface one or more of the carbonless sheets in the pad can be supported after they are peeled away from the adjacent underlying sheet. The top portion of the back card can have an elongate opening generally aligned with and spaced from that support edge with the part of the top portion between the opening and that support edge providing a handle by which the pad assembly can easily be moved from place to place. To provide space for that opening the top portion of the back card should project in the range of about 5 to 10 centimeters (2 to 4 inches) past the first edges of the carbonless sheets. Also, the top portion of the back card can have two aligned parallel elongate through slots positioned adjacent opposite sides of the back card and adapted to receive the support pegs on some types of easels on which the pad assembly might be supported.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
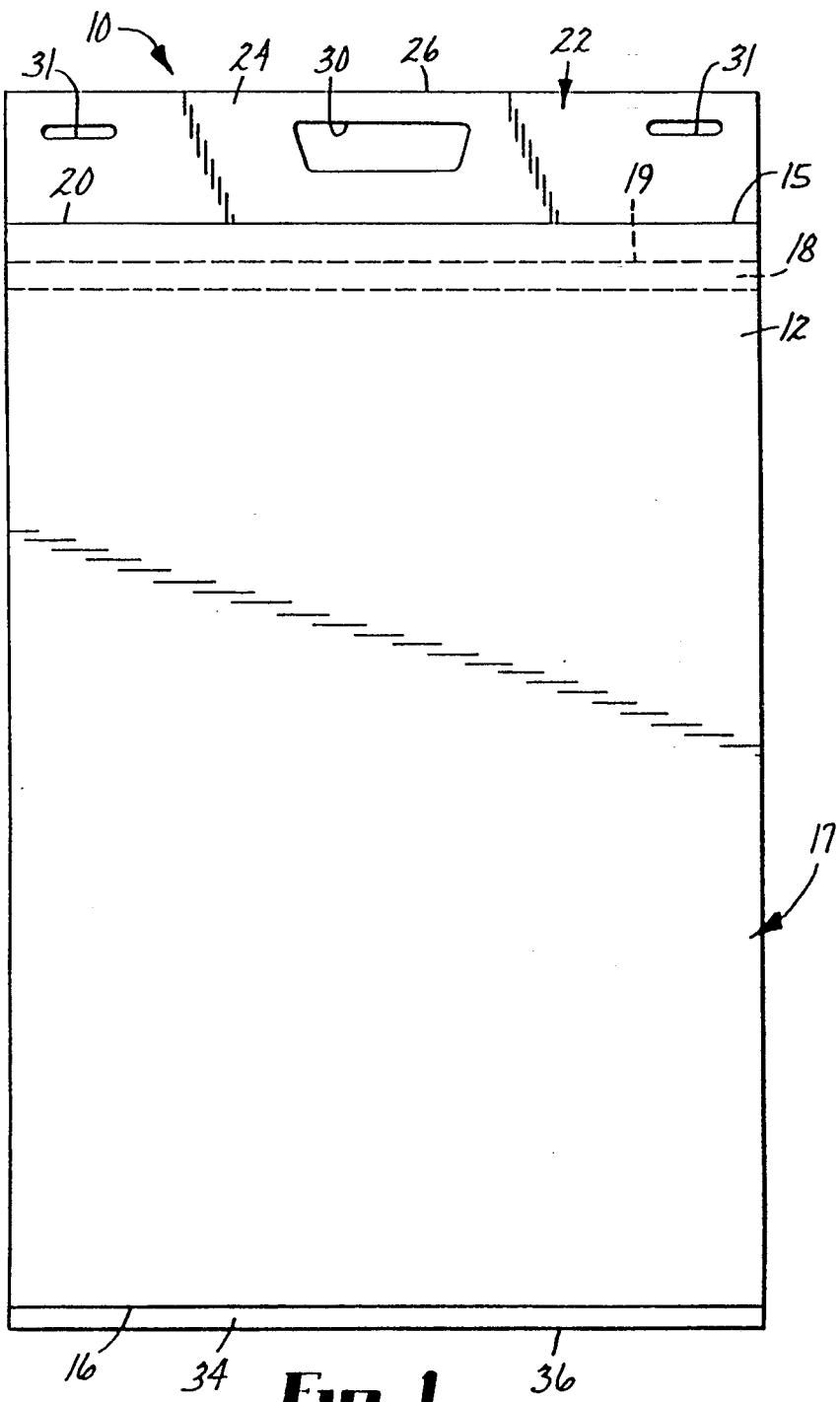
FIG. 1 is a front view of a pad assembly according to the present invention.
Figure 2:
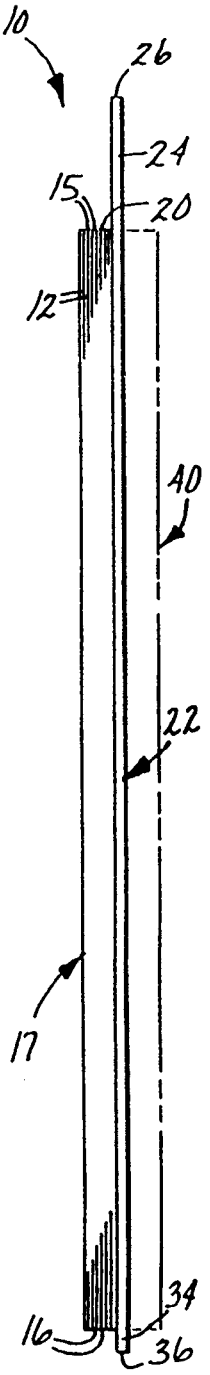
FIG. 2 is a side view of the pad assembly of FIG. 1.

The carbonless papers of the present invention comprise doner sheets which may be coated on the back with capsules which burst to transfer a color-former upon application of pressure (CB sheets), developer sheets which may be coated on the front with a developer (CF sheets), and optionally sheets coated with the developer on the front and color-former on the back (CFB sheets). The separate sheets of carbonless paper set are combined with the sheets being arranged (from top to bottom) in terms of a CB, optional CFB and CF, such that in each case a color former and a color developer will be brought into contact when the capsules containing the color-forming material are ruptured by pressure application. A variation on the use of CB, CFB and CF papers is self-contained (SC) carbonless paper wherein both color former and color developer material are applied to the same side of a sheet or incorporated into the fiber lattice of the paper itself.

Suitable carbonless paper capsules containing a solution of color precursor have been described in numerous patents. For example, U.S. Pat. No. 4,334,015 describes the use of urea-formaldehyde capsules in the size range of 1 to 50 microns: U.S. Pat. No. 4,201,404 discloses melamine-urea-formaldehyde condensation polymer shells in a size range between 10 and 15 microns; and U.S. Pat. No. 4,906,605 teaches that 50% volume capsule should be less than 12 microns, with the 95 percent by volume size being less than 18 microns.

The chemistry used in carbonless papers is of two general types. In the first type, the capsules contain a colorless dye precursor such as crystal violet lactone, 3,3-bis(1-ethyl-2-methylindolyl)-3-phthalide, 3-N,N-diethylamino-7-((N,N-dibenzylamino)fluoran or benzoyl leuco methylene blue. In this case, the mating color developer sheet is coated with acidic clay, a phenolic or similar acidic reagent to convert the colorless precursor to its colored form.

In the second type, the capsules contain a colorless ligand such as a monosubstituted or disubstituted dithiooxamide (DTO). In this case, the mating color developer sheet is coated with selected salts of nickel to convert the colorless ligand to a colored coordination compound.

A number of processes exist by which microcapsules can be manufactured. These varied processes provide different techniques for producing capsules of varying sizes, alternative materials for the composition of the capsule shell, and various different functional materials within the shell. Three methods that have achieved commercial utility are referred to as in-situ polymerization, interfacial polymerization, and coacervation encapsulation.

A wide variety of capsule materials can be used in making the capsule shells, including gelatin and synthetic polymeric materials. A popular material for shell formation is the product of the polymerization reaction between urea and formaldehyde, or between melamine and formaldehyde, or the polycondensation products of monomeric or low molecular weight polymers of dimethylolurea or methylolated urea with aldehydes. Some of these various processes and a variety of capsule forming materials are disclosed in U.S. Pat. Nos. 2,800,427; 2,800,458; 3,429,827; 3,516,846; 3,416,441; 4,087,376; 4,100,103; 4,909,605; and British Patent Spec. Nos. 950,443 and 1,046,409.

Referring now to the drawing, there is shown a pad assembly according to the present invention generally designated by the reference numeral 10, which pad assembly is in an embodiment sometimes called a "flip chart" or an "easel pad" which can be supported on a support such as an easel (not shown) at the front of the room during a meeting and used to record lists of items or ideas generated during a meeting.

Generally, the pad assembly 10 comprises a multiplicity of flexible carbonless sets 11 separated from each other by a divider 14. It is also contemplated that the pad assembly can comprise just one set 11. (not shown in drawings). Each set 11 comprises a multiplicity of flexible sheets 12, each carbonless sheet 12 being generally of the same size, having front and rear surfaces, having peripheral edges including first and second opposite edges 15 and 16, having a band 18 of repositionable pressure sensitive adhesive coated on the rear surface adjacent to and spaced by a small predetermined spacing from the first edge 15 and spaced by a large predetermined spacing from the second edge 16, the carbonless sheets 12 being disposed in a stack 17 with the corresponding peripheral edges of the carbonless sheets 12 aligned, the front and rear surfaces of adjacent carbonless sheets 12 facing each other, and the band 18 of repositionable pressure sensitive adhesive on each carbonless sheet 12 adhering that carbonless sheet 12 to the adjacent carbonless sheet 12 in the stack 17.

Figure 3:
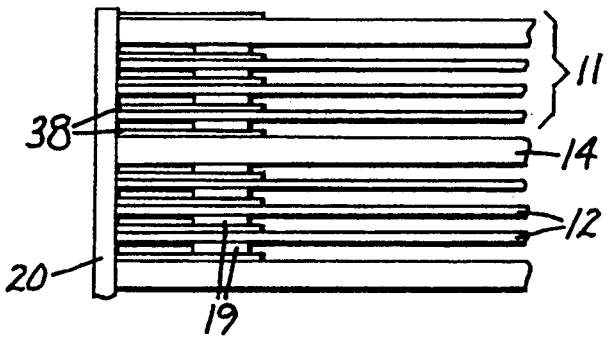
FIG. 3 is a fragmentary enlarged side view of another embodiment of the present invention.

If desired, the pad assembly 10 can comprise a multiplicity of flexible carbonless sets 11. Each set 11 comprises a multiplicity of flexible carbonless sheets 12. Shown in the FIG. 3 is a 3-part set of carbonless paper including top coated back sheet (CB), middle coated front and back sheet (CFB), and bottom coated front sheet (CF). Each CB coating contains rupturable capsules which when ruptured release reagents to produce a color-changing reaction at the adjacent CF coating.

The sets 11 can be separated from one another by a divider 14. The divider 14 may be made of a flexible sheet of a paper or any other material sufficiently thick to prevent imaging.

The pad assembly further comprises a layer 20 of padding compound disposed over and releasably adhered to the aligned first edges 15 of the carbonless sheets 12 in the stack 17. The layer 20 of padding compound is sufficiently flexible to allow, after the band 18 of repositionable pressure sensitive adhesive on the rear surface of one of the carbonless sheets 12 in the stack 17 is separated from the front surface of the adjacent carbonless sheet 12 in the stack 17, that one carbonless sheet 12 to be pivoted away from that adjacent carbonless sheet 12 by hinge-like flexing of the layer 20 of padding compound between the carbonless sheets 12, while the layer 20 of padding compound will remain adhered to the adjacent carbonless sheets 12 during such flexing while affording manual peeling of that one carbonless sheet 12 from the layer 20 of padding compound to separate that one carbonless sheet 12 from the stack 17. The layer 20 of padding compound can be formed with any of several commercially available adhesive padding compound materials, such as "Merit" padding adhesive from Merrit Pad Co., Plainsville, Ohio; "Hurst Graphics" padding compound from Hurst Graphics, Los Angeles, Calif.; or "Champadco" padding cement from Champion Mfg. Co., Charlotte, N.C.

The small predetermined spacing between the first edge 15 of each carbonless sheet 12 to which the layer 20 of padding compound is adhered and the adjacent edge 19 of the band 18 of repositionable pressure sensitive adhesive on each carbonless sheet 12 provides a tactile feel when the band 18 of repositionable pressure sensitive adhesive on the rear surface of one of the carbonless sheets 12 in the stack 17 separates from the front surface of the adjacent sheet 12 in the stack 17 as the carbonless sheets are manually peeled apart. That tactile feel allows the person applying the peeling force to reduce or terminate it and thereby restricts inadvertent separation of that carbonless sheet 12 from the layer 20 of padding compound. For carbonless sheets 12 of the dimensions indicated above, the tactile feel that restricts inadvertent separation of one of the carbonless sheets 12 from the layer 20 of padding compound is most pronounced and effective when that spacing is at least 1.2 centimeters (0.5 inch) or more in a direction normal to the first edge 15 of the sheet 12, however the tactile feel is produced for the carbonless sheets of that size when that spacing is as little as 0.6 centimeter (0.25 inch). After one of the carbonless sheets 12 is intentionally separated from the layer 20 of padding compound, the band 18 of repositionable pressure sensitive adhesive affords removably adhering that carbonless sheet 12 to a vertical support surface.

In addition, the small predetermined spacing between the first edge 15 of each carbonless sheet 12 to which the layer 20 of padding compound is adhered and the adjacent edge 19 of the band 18 of repositionable pressure sensitive adhesive on each carbonless sheet may be perforated to aid in the removal of the carbonless sheets. A preferred method of perforation uses a laser to perforate the sheets prior to assemby of the pad. Such methods of perforation are described World Patent Application No. 92-03520.

The pad assembly 10 further includes a back card 22 of a stiff material (e.g., rigid cardboard or clipboard 864 millimeters (34 inches) high by 580 millimeters (22.8 inches) wide) having a front surface to which the rear surface of the bottom most carbonless sheet 12 in the stack 17 is attached. The front surface of the back card 22 is coextensive with the carbonless sheets 12 in the stack 17, and the back card 22 has a top portion 24 projecting past the aligned first edges 15 of the carbonless sheets 12. The top portion 24 has a peripheral support edge 26 generally parallel to the first edges 15 of the carbonless sheets 12 preferably spaced about 9 centimeters (3.5 inches) from the first edges 15 of the carbonless sheets 12, over which support edge 26 one or more of the carbonless sheets 12 in the stack 17 can be supported after the bands 18 of pressure sensitive adhesive on those carbonless sheets 12 have been peeled away from the adjacent underlying carbonless sheet 12 and those carbonless sheets 12 are bent back over the support edge 26. The top portion 24 has an elongate through opening 30 generally aligned with and spaced from the support edge 26 with the part of the top portion 24 between the opening 30 and the support edge 26 providing a handle for the pad assembly 10 by which the pad assembly 10 can conveniently be manually moved around. Also, the top portion 24 has two aligned parallel elongate through slots 31 positioned adjacent opposite sides of the back card 22 and aligned parallel to the support edge 26, the slots 31 being adapted to receive the support pegs on some types of easels on which the pad assembly 10 might be supported.

The back card 22 also has a bottom portion 34 projecting past the aligned second edges 16 of the carbonless sheets 12. The bottom portion 34 has a peripheral supported edge 36 generally parallel to the second edges 16 of the sheets 12 and spaced in the range of about 0.6 to 2.5 centimeters (0.25 to 1 inch) and preferably about 1.3 centimeters (0.5 inch) from the second edges 16 of the sheets 12, which supported edge 36 is adapted to be supported on a support surface such as on the support ledge of an easel while the bottom portion 34 spaces the second edges 16 of the carbonless sheets 12 sufficiently from that support surface to afford easy manual access to the carbonless sheets 12 as may be needed to use the pad assembly 10.

Preferably the band 18 of repositionable pressure sensitive adhesive that extends parallel to the first edge 15 is continuous, and has a width in a direction normal to the first edge 15 in the range of 3.75 to 6.25 centimeters (1.5 to 2.5 inches), with that band 18 preferably being about 5 centimeter (2 inches) wide. Alternatively, however, the band 18 of repositionable pressure sensitive adhesive could comprise a plurality of spaced areas coated with pressure sensitive adhesive that also has a width in a direction normal to the first edge 15 in that range.

While the repositionable pressure sensitive adhesive used to form the band 18 could be of the type used on "Post-it" brand notes that is described in U.S. Pat. No. 3,691,140, the content whereof is incorporated herein by reference, preferably the repositionable pressure sensitive adhesive is an adhesive containing collapsed hollow microspheres of the type described in U.S. Pat. No. 5,045,569, the content whereof is incorporated herein by reference. Briefly, the hollow microspheres in the adhesive are predominantly acrylates, with a minor portion of a more polar comonomer, and are polymerized in generally spherical shapes with small fluid filled inclusions. When the adhesive is coated on the sheets 12 to form the bands 18, the fluid filling the inclusions evacuates, and the microspheres collapse as they dry compared to solid microspheres which dry to a more or less spherical shape. When dry, the hollow collapsed microspheres in the adhesive are pancake like in shape. Preferably, the pressure sensitive adhesive in the bands 18 comprises hollow collapsed microspheres consisting of a 94/6 ratio of acrylate to polar monomer with diameters of about 60 microns. The adhesive containing the hollow collapsed microspheres provides advantages compared to adhesives containing solid microspheres. The hollow collapsed microspheres adhere well to the sheets 12 without the use of special primers so that few of the collapsed microspheres will transfer from the carbonless sheets 12 to a surface to which the sheets 12 are temporarily adhered by the bands 18 of adhesive. Also, the hollow collapsed microspheres provide relatively high adhesive shear strength. (i.e., "shear strength" is a measure of the cohesiveness or internal strength of an adhesive. That internal strength is measured by determining the amount of force required to pull an adhesive coated strip or sheet from a standard flat surface in a direction parallel to that surface to which the adhesive on the strip has been affixed with definite pressure, and is measured in time required to pull a standard area of adhesive coated material from that surface under the stress of a constant, standard load). The shear strength of the preferred adhesive containing the hollow collapsed microspheres is significantly greater than that needed for good adhesion to smooth wall surfaces, and allows the carbonless sheets 12 to be removably attached for a long period of time to many wall surfaces that are irregular and/or uneven.

The portion of the front surface of each carbonless sheet 12 to which the band of adhesive 18 on the adjacent sheet is adhered to help retain the carbonless sheets 12 in the stack 17 is coated with a layer 38 of a suitable back sizing material (see FIG. 3) to provide a desired releasable level of adhesion between the band of adhesive 18 and the adjacent sheet 12, which back sizing material for the preferred pressure sensitive adhesive described above can be that described in U.S. Pat. No. 2,532,011, the content whereof is incorporated herein by reference.

After writing on the front surface of the top carbonless sheet 12 in the pad assembly if he chooses to do so, a user of the pad assembly 10 can peel the band of adhesive 18 on that top carbonless sheet 12 away from the carbonless second sheet 12 in the pad assembly 10 by pulling on the top carbonless sheet 12 adjacent its second edge 16 in a direction generally at a right angle to the front surface of the underlying carbonless sheet 12. Tension in the top sheet 12 caused by such pulling will progressively peel the band 18 of adhesive from the carbonless underlying sheet 12, and the user will feel the top carbonless sheet 12 move much more easily away from the underlying carbonless sheet 12 as the last portion of the band 18 separates from the underlying sheet 12, thereby providing the user with a tactile signal that he should stop pulling on the carbonless sheet 12 if he does not wish to separate the top carbonless sheet 12 from the pad assembly 10. If the user does not wish to remove the top carbonless sheet 12 from the pad assembly 10, he can then stop pulling on the carbonless sheet and bend the top carbonless sheet 12 back over the support edge 26 on the top portion 24 of the back card 22, whereupon the layer 20 of padding compound will bend between the top carbonless sheet 12 and the underlying carbonless sheet 12 completely exposing the front surface of the underlying sheet while the layer 20 of padding compound remains adhered to the top sheet supported over the support edge 26. If the user wishes to remove the top carbonless sheet 12 from the pad assembly he can simply peel its first edge 15 away from the layer 20 of padding compound from which the top sheet will separate cleanly leaving a smooth first edge 15 on the separated carbonless sheet 12, whereupon the user may releasably adhere the removed sheet to a vertical support surface using the band 18 of pressure sensitive adhesive. After the uppermost carbonless sheet 12 is either bent back over the support edge 26 or removed, a user may similarly peel away each successive underlying carbonless sheet 12 and either also bend it back over the support edge 26 or remove it from the pad assembly 10. Subsequently, if desired, the user can reposition any carbonless sheets 12 bent back over the support edge 26 in their original position on the pad and readhere them to the underlying carbonless sheet 12 on the pad using the bands 18 of adhesive. Also, a user can remove a number of carbonless sheets 12 from the pad assembly while leaving them adhered together, whereupon the user can adhere those removed sheets to a surface using the band 18 of adhesive on the bottom most carbonless sheet 12 so that the user now in effect has two pad assemblies from which individual carbonless sheets 12 can be peeled away and treated in the manners described above. The bands 18 of adhesive will provide good adhesion to even rough vertical support surfaces, such as those of cloth or painted cement blocks, while affording clean removal of the sheets from all surfaces without leaving adhesive residue or damaging the surface such as by removing paint, paper, or fabric from the surfaces.

The present invention has now been described with reference to one embodiment thereof. It will be apparent to those skilled in the art that many changes can be made in the embodiment described without departing from the scope of the present invention. For example, pads having some of the claimed structural combinations with sizes similar to those of conventional pads of "Post-it" brand notes available from Minnesota Mining and Manufacturing Company may be useful for some purposes. Thus the scope of the present invention should not be limited to the structure described in this application, but only by structures described by the language of the claims and the equivalents of those structures.

We claim:

1. A pad assembly comprising:

a multiplicity of flexible sheets, each sheet being generally of the same size, having front and rear surfaces, having peripheral edges including first and second opposite edges, having a band of repositionable pressure sensitive adhesive coated on said rear surface adjacent to and spaced by a small predetermined spacing from said first edge and spaced by a large predetermined spacing from said second edge, said sheets being disposed in a stack with the corresponding peripheral edges of the sheets aligned, the front and rear surfaces of adjacent sheets facing each other, and the band of repositionable pressure sensitive adhesive on each sheet adhering that sheet to the adjacent sheet in the stack; and a layer of padding compound disposed over and releasably adhered to the aligned first edges of the sheets in the stack, said padding compound being sufficiently flexible to allow, after the band of repositionable pressure sensitive adhesive on the rear surface of one of the sheets in the stack is separated from the front surface of the adjacent sheet in the stack, that one sheet to be pivoted away from that adjacent sheet by hinge-like flexing of the padding compound between the sheets, and said layer of padding compound being sufficiently adhered to the sheets to remain adhered to the adjacent sheets during such flexing while affording manual peeling of the one sheet from the padding compound to separate that one sheet from the stack; and, an image transfer system arranged between each of the plurality of sheets for transferring a writing on one of the sheets to another sheet.

2. A pad assembly according to claim 1 wherein said image transfer system is a plurality of carbonless sheets containing a carbonless coating applied to a surface of each of the plurality of sheets.

3. A pad assembly according to claim 2 wherein said surface to which said carbonless coating is applied is an underside of each of the plurality of sheets.

4. A pad assembly according to claim 2 wherein said surface to which said carbonless coating is applied is a topside of each of the plurality of sheets.

5. A pad assembly comprising:

a multiplicity of flexible carbonless sheets, each carbonless sheet being generally of the same size, having front and rear surfaces, having peripheral edges including first and second opposite edges, having a band of repositionable pressure sensitive adhesive comprising hollow collapsed microspheres of polymeric material coated on said rear surface adjacent to and spaced by a small predetermined spacing from said first edge and spaced by a large predetermined spacing from said second edge, said carbonless sheets being disposed in a stack with the corresponding peripheral edges of the carbonless sheets aligned, the front and rear surfaces of adjacent carbonless sheets facing each other, and the band of repositionable pressure sensitive adhesive on each carbonless sheet adhering that carbonless sheet to the adjacent carbonless sheet in the stack; and a layer of padding compound disposed over and releasably adhered to the aligned first edges of the carbonless sheets in the stack, said padding compound being sufficiently flexible to allow, after the band of repositionable pressure sensitive adhesive on the rear surface of one of the carbonless sheets in the stack is separated from the front surface of the adjacent carbonless sheet in the stack, that one carbonless sheet to be pivoted away from that adjacent carbonless sheet by hinge-like flexing of the padding compound between the carbonless sheets, and said layer of padding compound being sufficiently adhered to the carbonless sheets to remain adhered to the adjacent carbonless sheets during such flexing while affording manual peeling of the one carbonless sheet from the padding compound to separate that one carbonless sheet from the stack, said small predetermined spacing between said band of repositionable pressure sensitive adhesive and said first edge providing a tactile feel when the band of repositionable pressure sensitive adhesive on the rear surface of one of the carbonless sheets in the stack is separated from the front surface of the adjacent carbonless sheet in the stack by manual peeling apart of the carbonless sheets that allows the peeling force being manually applied to be terminated and thereby restricts inadvertent separation of that carbonless sheet from the padding compound, and the said band of repositionable pressure sensitive adhesive affords removable supporting adhesion of one of the carbonless sheets separated from the stack to a vertical support surface.

6. A pad assembly comprising:

a multiplicity of flexible carbonless sheets, each carbonless sheet being generally of the same size, having front and rear surfaces, having peripheral edges including first and second opposite edges, having a band of repositionable pressure sensitive adhesive coated on said rear surface adjacent to and spaced by a small predetermined spacing from said first edge and spaced by a large predetermined spacing from said second edge, said carbonless sheets being disposed in a stack with the corresponding peripheral edges of the carbonless sheets aligned, the front and rear surfaces of adjacent carbonless sheets facing each other, and the band of repositionable pressure sensitive adhesive on each carbonless sheet adhering that carbonless sheet to the adjacent carbonless sheet in the stack; and a layer of padding compound disposed over and releasably adhered to the aligned first edges of the carbonless sheets in the stack, said padding compound being sufficiently flexible to allow, after the band of repositionable pressure sensitive adhesive on the rear surface of one of the carbonless sheets in the stack is separated from the front surface of the adjacent carbonless sheet in the stack, that one carbonless sheet to be pivoted away from that adjacent carbonless sheet by hinge-like flexing of the padding compound between the carbonless sheets, and said layer of padding compound being sufficiently adhered to the carbonless sheets to remain adhered to the adjacent carbonless sheets during such flexing while affording manual peeling of the one carbonless sheet from the padding compound to separate that one carbonless sheet from the stack, said small predetermined spacing between said band of repositionable pressure sensitive adhesive and said first edge providing a tactile feel when the band of repositionable pressure sensitive adhesive on the rear surface of one of the carbonless sheets in the stack is separated from the front surface of the adjacent carbonless sheet in the stack by manual peeling apart of the carbonless sheets that allows the peeling force being manually applied to be terminated and thereby restricts inadvertent separation of that carbonless sheet from the padding compound, and the said band of repositionable pressure sensitive adhesive affords removable supporting adhesion of one of the carbonless sheets separated from the stack to a vertical support surface;

said pad assembly further including a stiff back card having a front surface, the rear surface of the bottom most carbonless sheet in the stack being attached to the front surface of the back card, and the front surface of the back card being at least coextensive with the carbonless sheets in the stack, said back card having a top portion projecting past the aligned first edges of said carbonless sheets, said top portion having a peripheral support edge generally parallel to said first edges of said carbonless sheets, and said top portion having two parallel elongate through slots positioned adjacent opposite sides of the back card and aligned parallel to said support edge, said slots being adapted to receive the support pegs on some types of easels on which said pad assembly might be supported.

7. A pad assembly comprising:

a multiplicity of flexible carbonless sheets, each carbonless sheet being generally of the same size, having front and rear surfaces, having peripheral edges including first and second opposite edges, having a band of repositionable pressure sensitive adhesive coated on said rear surface adjacent to and spaced by a small predetermined spacing from said first edge and spaced by a large predetermined spacing from said second edge, said carbonless sheets being disposed in a stack with the corresponding peripheral edges of the carbonless sheets aligned, the front and rear surfaces of adjacent carbonless sheets facing each other, and the band of repositionable pressure sensitive adhesive on each carbonless sheet adhering that carbonless sheet to the adjacent carbonless sheet in the stack; and a layer of padding compound disposed over and releasably adhered to the aligned first edges of the carbonless sheets in the stack, said padding compound being sufficiently flexible to allow, after the band of repositionable pressure sensitive adhesive on the rear surface of one of the carbonless sheets in the stack is separated from the front surface of the adjacent carbonless sheet in the stack, that one carbonless sheet to be pivoted away from that adjacent carbonless sheet by hinge-like flexing of the padding compound between the carbonless sheets, and said layer of padding compound being sufficiently adhered to the carbonless sheets to remain adhered to the adjacent carbonless sheets during such flexing while affording manual peeling of the one carbonless sheet from the padding compound to separate that one carbonless sheet from the stack, said small predetermined spacing between said band of repositionable pressure sensitive adhesive and said first edge providing a tactile feel when the band of repositionable pressure sensitive adhesive on the rear surface of one of the carbonless sheets in the stack is separated from the front surface of the adjacent carbonless sheet in the stack by manual peeling apart of the carbonless sheets that allows the peeling force being manually applied to be terminated and thereby restricts inadvertent separation of that carbonless sheet from the padding compound, and the said band of repositionable pressure sensitive adhesive affords removable supporting adhesion of one of the carbonless sheets separated from the stack to a vertical support surface;

said pad assembly further including a stiff back card having a front surface, the rear surface of the bottom most carbonless sheet in the stack being attached to the front surface of the back card, and the front surface of the back card being at least coextensive with the carbonless sheets in the stack, said back card having a top portion projecting past the aligned first edges of said carbonless sheets, said top portion having a peripheral support edge generally parallel to said first edges of said carbonless sheets spaced in the range of about 5 to 10 centimeters (2 to 4 inches) from said first edges of said carbonless sheets, and said top portion having an elongate opening generally aligned with and spaced from said peripheral edge of said top portion with the part of said top portion between said opening and said support edge providing a handle for said pad assembly.

8. A pad assembly according to claim 7 wherein said carbonless sheets have a dimension between said first and second edges of about 775 millimeters (30.5 inches) and a width in a direction parallel to said first and second edges of about 580 millimeters (22.8 inches).

9. A pad assembly according to claim 7 wherein said back card has a rear surface opposite said front surface, and said pad assembly includes a second stack of carbonless sheets attached together by bands of repositionable pressure sensitive adhesive and a layer of padding compound disposed in the same location in said second stack as said bands of repositionable pressure sensitive adhesive and said layer of padding compound on said stack attached to the front surface of the said back card, said second stack being attached to the rear surface of said back card in a position generally opposite said stack attached to the front surface of said back card.

10. A pad assembly comprising:

a multiplicity of flexible carbonless sheets, each carbonless sheet being generally of the same size, having front and rear surfaces, having peripheral edges including first and second opposite edges, having a band of repositionable pressure sensitive adhesive coated on said rear surface adjacent to and spaced by a small predetermined spacing from said first edge and spaced by a large predetermined spacing from said second edge, said carbonless sheets being disposed in a stack with the corresponding peripheral edges of the carbonless sheets aligned, the front and rear surfaces of adjacent carbonless sheets facing each other, and the band of repositionable pressure sensitive adhesive on each carbonless sheet adhering that carbonless sheet to the adjacent carbonless sheet in the stack; and a layer of padding compound disposed over and releasably adhered to the aligned first edges of the carbonless sheets in the stack, said padding compound being sufficiently flexible to allow, after the band of repositionable pressure sensitive adhesive on the rear surface of one of the carbonless sheets in the stack is separated from the front surface of the adjacent carbonless sheet in the stack, that one carbonless sheet to be pivoted away from that adjacent carbonless sheet by hinge-like flexing of the padding compound between the carbonless sheets, and said layer of padding compound being sufficiently adhered to the carbonless sheets to remain adhered to the adjacent carbonless sheets during such flexing while affording manual peeling of the one carbonless sheet from the padding compound to separate that one carbonless sheet from the stack, said small predetermined spacing between said band of repositionable pressure sensitive adhesive and said first edge providing a tactile feel when the band of repositionable pressure sensitive adhesive on the rear surface of one of the carbonless sheets in the stack is separated from the front surface of the adjacent carbonless sheet in the stack by manual peeling apart of the carbonless sheets that allows the peeling force being manually applied to be terminated and thereby restricts inadvertent separation of that carbonless sheet from the padding compound, and the said band of repositionable pressure sensitive adhesive affords removable supporting adhesion of one of the carbonless sheets separated from the stack to a vertical support surface;

said pad assembly further including a stiff back card having a front surface, the rear surface of the bottom most carbonless sheet in the stack being attached to the front surface of the back card, and the front surface of the back card being at least coextensive with the carbonless sheets in the stack, said back card having a top portion projecting past the aligned first edges of said carbonless sheets, said top portion having a peripheral support edge generally parallel to said first edges of said carbonless sheets spaced in the range of about 5 to 10 centimeters (2 to 4 inches) from said first edges of said carbonless sheets, and said carbonless sheets having a dimension between said first and second edges of about 775 millimeters (30.5 inches) and a width in a direction parallel to said first and second edges of about 580 millimeters (22.8 inches).

11. A pad assembly comprising:

a multiplicity of flexible carbonless sheets, each carbonless sheet being generally of the same size, having front and rear surfaces, having peripheral edges including first and second opposite edges, having a band of repositionable pressure sensitive adhesive coated on said rear surface adjacent to and spaced by a small predetermined spacing from said first edge and spaced by a large predetermined spacing from said second edge, said carbonless sheets being disposed in a stack with the corresponding peripheral edges of the carbonless sheets aligned, the front and rear surfaces of adjacent carbonless sheets facing each other, and the band of repositionable pressure sensitive adhesive on each carbonless sheet adhering that carbonless sheet to the adjacent carbonless sheet in the stack; and a layer of padding compound disposed over and releasably adhered to the aligned first edges of the carbonless sheets in the stack, said padding compound being sufficiently flexible to allow, after the band of repositionable pressure sensitive adhesive on the rear surface of one of the carbonless sheets in the stack is separated from the front surface of the adjacent carbonless sheet in the stack, that one carbonless sheet to be pivoted away from that adjacent carbonless sheet by hinge-like flexing of the padding compound between the carbonless sheets, and said layer of padding compound being sufficiently adhered to the carbonless sheets to remain adhered to the adjacent carbonless sheets during such flexing while affording manual peeling of the one carbonless sheet from the padding compound to separate that one carbonless sheet from the stack, said small predetermined spacing between said band of repositionable pressure sensitive adhesive and said first edge being at least 0.6 centimeter (0.25 inch) wide in a direction normal to said first edge and providing a tactile feel when the band of repositionable pressure sensitive adhesive on the rear surface of one of the carbonless sheets in the stack is separated from the front surface of the adjacent carbonless sheet in the stack by manual peeling apart of the carbonless sheets that allows the peeling force being manually applied to be terminated and thereby restricts inadvertent separation of that carbonless sheet from the padding compound, and the said band of repositionable pressure sensitive adhesive affords removable supporting adhesion of one of the carbonless sheets separated from the stack to a vertical support surface.

12. A pad assembly according to claim 11 wherein a divider means is inserted underneath a selected number of said carbonless sheets.

13. A pad assembly according to claim 11 wherein said small predetermined spacing between said band of repositionable pressure sensitive adhesive and said first edge is at least 1.2 centimeter (0.5 inch) wide in a direction normal to said first edge.

14. A pad assembly according to claim 11 wherein said band of repositionable pressure sensitive adhesive is continuous, extends parallel to said first edge, and has a width in direction normal to said first edge in the range of 3.8 to 6.4 centimeters (1.5 to 2.5 inches).

15. A pad assembly according to claim 11 wherein said band of repositionable pressure sensitive adhesive comprises a plurality of spaced areas coated with pressure sensitive adhesive and extends parallel to said first edge.

16. A pad assembly according to claim 11 further including a stiff back card having a front surface, the rear surface of the bottom most carbonless sheet in the stack being attached to the front surface of the back card, and the front surface of the back card being at least coextensive with the carbonless sheets in the stack.

17. A pad assembly according to claim 11 wherein said repositionable pressure sensitive adhesive comprises hollow collapsed microspheres consisting of a 94/6 ration of iso-octyl acrylate to acrylic acid with diameters of about 60 microns.

* * * * *